US005823274A

United States Patent [19]

Wisakanto et al.

[11] Patent Number: 5,823,274

[45] Date of Patent: Oct. 20, 1998

[54] DRILL ROD

[75] Inventors: Risto Wisakanto, Tampere; Harri Sjöholm, Kangasala, both of Finland

[73] Assignee: Oy Winrock Technology, Ltd., Tampere, Finland

[21] Appl. No.: 793,885

[22] PCT Filed: Sep. 8, 1995

[86] PCT No.: PCT/FI95/00487

§ 371 Date: May 1, 1997

§ 102(e) Date: May 1, 1997

[87] PCT Pub. No.: WO96/08682

PCT Pub. Date: Mar. 21, 1996

[30] Foreign Application Priority Data

Jun. 16, 1994 [FI] Finland ..... 944291

[51] Int. Cl.[6] ..... E21B 17/042

[52] U.S. Cl. ..... 175/215; 175/415; 175/418; 175/320

[58] Field of Search ..... 175/414, 415, 175/417, 418, 215, 320

[56] References Cited

U.S. PATENT DOCUMENTS

| | | | |
|---|---|---|---|
| 4,274,663 | 6/1981 | Becker et al. | 175/173 X |
| 4,337,563 | 7/1982 | Becker et al. | 175/215 X |
| 4,836,305 | 6/1989 | Curlett . | |

FOREIGN PATENT DOCUMENTS

| | | |
|---|---|---|
| 0 571 346 A1 | 11/1993 | European Pat. Off. . |
| 40 27 414 C1 | 8/1980 | Germany . |
| 38 07 321 | 3/1988 | Germany . |
| WO/9321418 | 10/1993 | WIPO . |

*Primary Examiner*—Roger J. Schoeppel
*Attorney, Agent, or Firm*—Burns, Doane, Swecker & Mathis LLP

[57] ABSTRACT

A drill rod suitable for a hydraulic drilling apparatus, at the drilling end (I) of which there is a drilling device (1), that includes at least drilling equipment (2) and hammering equipment (5) as well as preferably flushing equipment (10) also, to drill a hole by use of the drilling equipment (2) by a feeding motion along the longitudinal axis (s) of the drilling device (1) and by a rotational motion (w) around the longitudinal axis (s) as well as by a to-and-from or a like hammering motion (t). The drilling device (1) has jointing equipment (3) for fastening of a drill rod (4) preferably in a removable way to increase the drilling depth of the drilling apparatus. The drill rod (4) consists of a casing structure (8) equipped with corresponding jointing equipment (3) and at least partly inside of which there has been arranged a flow arrangement (7) for leading of hydraulic fluid and/or flushing medium and a coupling arrangement (6) for connecting of the flow arrangement (7) of the drill rod (4) with a corresponding flow arrangement (7) in the drilling device (1) and/or in another drill rod (4) and/or at the driving end (II) of the drilling apparatus. The drill rod (4) is arranged at least partly dismountable to enable its maintenance, by connecting at least part of the part entireties belonging to the same, such as of the casing structure (8), the jointing equipment (3), the coupling equipment (6) and/or the flow arrangement (7) by use of fastening equipment (9) removable with other parts of the drill rod (4).

7 Claims, 4 Drawing Sheets

DRILL ROD

Figure 1:
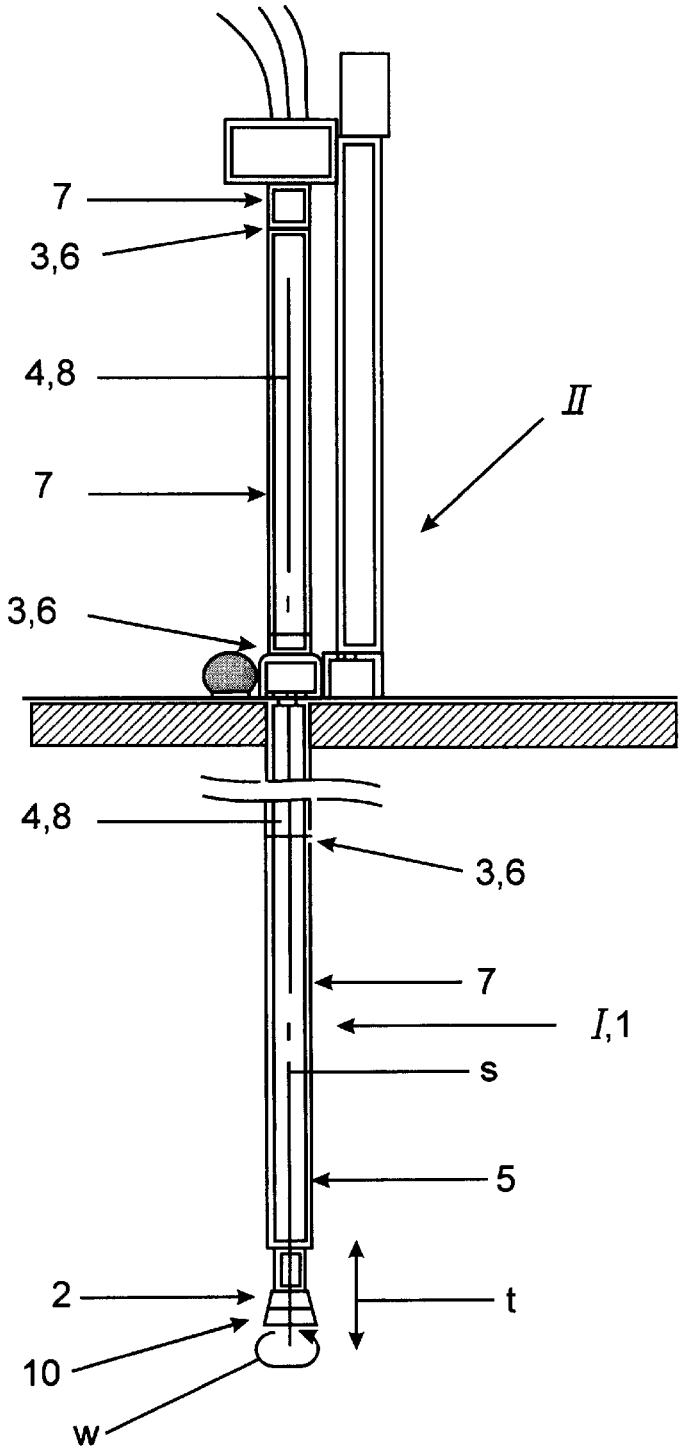

The present invention relates to a drill rod for a hydraulic drilling apparatus, at the drilling end of which there is a drilling device, that includes at least drilling means and hammering means as well as preferably flushing means, to drill a hole by means of the drilling means, preferably assisted by flushing medium led to the flushing means from the flushing system of the drilling apparatus and made functional by a transmission arrangement situated at the driving end of the drilling apparatus, by a feeding motion along the longitudinal axis of the drilling device and by a rotational motion around the longitudinal axis as well as by a to-and-from or a like hammering motion carried out by hydraulic fluid led to the hammering means from the hydraulic system of the drilling apparatus. The drilling device has jointing means for fastening of a drill rod preferably in a removable way to increase the drilling depth of the drilling apparatus. The drill rod consists of a casing structure equipped with corresponding jointing means and at least partly inside of which there has been arranged a flow arrangement for leading of hydraulic fluid and/or flushing medium and a coupling arrangement for connecting of the flow arrangement of the drill rod with a corresponding flow arrangement in the drilling device and/or in another drill rod and/or at the driving end of the drilling apparatus. The drill rod is arranged at least partly dismountable to enable its maintenance, whereby the casing structure includes an end part, that is attached to a middle part of the casing structure, preferably at both ends of the same by means of quick lock principle, such as by a thread joint or accordingly, in connection with which there exists at least a part of the jointing means, the coupling means and/or the flow arrangement.

Arrangements in which the hammering means operated by compressed air, are placed advantageously at the drilling head of a down-the-hole drill, have already been known for a long time and they have also been widely used in mineral industry. In this case an advantage of the hammering means placed in the hole is, that the strokes of the same are aimed directly to the drill bit, whereby it is possible to decrease energy loss and unnecessary wearing of components belonging to the arrangement to lower level than in solutions, in which the hammering means are placed in the rear end of the drill rods. In connection with pneumatic drilling machines compressed air is usually used to finish drilling waste, also. However, it is not beneficial to use the drilling machine with compressed air, because a very high power of the compressor unit is thus needed. In addition to that, the efficiency of a pneumatic system is clearly lower than the same of a hydraulic system.

Drill rods being used traditionally are usually uniform fixed entireties, that include in addition to the jointing means or threadings placed at the ends of the same pipes inlaid at the sides of the same or conduits or ducts arranged integrated or with separated pipes inside the same to lead said hydraulic fluid and generally flushing medium as well. When a conventional threading has been used as the jointing arrangement between the drill rods certain constructive problems are caused concerning the leading of hydraulic fluid and flushing medium from one part to another. Furthermore the prior art solutions with a one-ended thread will tend to untighten during use such that the hammer risks being dropped in the hole. Slowness of installation procedures is caused as well, because the drill rods must be "screwed" several rounds in relation of each other.

On the other hand dismountable drill rods for example for maintenance purposes are known earlier for example from EP-application 0 571 346 and U.S. Pat. No. 4,836,305. A drill rod according to the above EP-application has a middle part, inside of which there are flow ducts. At the ends of the same there are male and female end parts fastened for example by means of a thread joint. Drill rods mounted this way may be installed on site as a whole in one piece by exploiting the usual threading when connecting the drill rods to each other. With the solution above it is thus not possible to increase particularly the efficiency of the connecting of the drill rods. The solution in question is very unprofitable structurally and due to that in the sense of manufacturing costs, also, because nearly all of the parts belonging to the drill rod must be manufactured for example by machining or accordingly.

In the U.S. Pat. No. 4,836,305 a drill rod assembly is presented, the purpose of which essentially differs from that of the drill rod presented in the above EP-application for example, whereby the assembly is intended for example for subterranean oil drilling, that is arranged dismountable especially due to the purpose of the same. The solution in question includes part entireties advantageously made for example of standard pipes or the like forming the casing part and the flow and electricity ducts inside the same. Each part entirety, formed by the casing part and the pipes inside the same, is arranged to be coupled with a following similar one by means of a separate coupling piece, that is to be fastened to a sleeve with internal threads, that has been attached at the end of the part entirety. At both ends of the coupling piece there ire external threads corresponding the internal threads of the sleeve as well as internal flow and coupling arrangements.

In one embodiment at the first end of the coupling piece belonging to the drill rod assembly there are advantageously for example slide fittings and gaskets and threaded holes at the other end of the same for each separate pipe to be placed inside the external pipe to "anchor" those pipes by their one end. In this case each pipe must be connected to the same by screwing each single one individually. This kind of construction and action is possible in the purpose of the patent in question, wherein drilling with the same drill rod part entirety, which is usually relatively long, may continue even for several days. This is why the speed of connecting together separate parts of the drill rod assembly has thus not been an essential question in the above solution, instead a more important fact is, that the flow and cable pipes or the like inside the external cover of the assembly are connected as tensionless as possible inside the cover part. This is why the above U.S. patent does not comprise a compact drill rod, that could be connected rapidly as a whole in one piece directly to another drill rod.

It is an aim of the drill rod according to this invention to achieve a decisive improvement in the problems presented above and thus to raise substantially the level of knowledge in the field. To achieve this aim, the drill rod according to the invention is primarily characterized in that the coupling means include closing means arranged essentially in connection with the end part, which closing means, while detaching/attaching the drill rod, by means of auxiliary power, such as by influence of pressurized medium, spring power or like, preferably independently close/open at least the flow openings transmitting hydraulic fluid.

The most important advantages of the drill rod according to the invention are the simplicity, reliability and convenience of its construction and use, which matters are essential preconditions for both technically advantageous and ecologically profitable working. In this case the drill rod comprises coupling arrangements, which, while detaching successive parts of the drilling apparatus close at least the flow openings of ducts transmitting pressurized medium, that are being opened, whereby, when detaching the drill rods from each other, hydraulic fluid remains inside the loosened drill rods, which in this case act in principle as reservoirs. When connecting the drill rods again, hydraulic fluid inside the same is thanks to this immediately ready for use and it is not needed to feed compensating hydraulic fluid for this reason. The above arrangement decreases thus significantly consumption of hydraulic fluid as well as the surroundings, operating personnel, equipment and the like getting dirty. In addition to that the invention enables the changing of single parts or part entireties of the drill rod, also, by simply dismounting the drill rod for example by loosening the end parts, that are connected for example by means of a screw or bayonet joint to the middle part belonging to the drill rod. In this case the same drill rod or the part entireties belonging to the same may be used again continuously after small maintenance activities. Moreover the invention enables a smooth and rapid attachment detachment of the drill rods, when using as an advantageous embodiment a twin ended threading as the jointing means between the drill rods, wherewith the joint is detachable/attachable with a very short mutual twisting movement of the drill rods. The invention enables an advantageous construction of the drill rod in such respect, also, that the external cover under wear in each of the middle and/or end part belonging to the drill rod may be made of pipe material as low-cost as possible. In addition it is also possible to construct the drill rod so that the internal parts of the drill rod requiring more accurate machining, are made of good material, because wearing of the same is smaller. In this case it is possible to use them continuously, while changing other parts of the drill rod, that are worn more rapidly.

Advantageous embodiments of the drill rod according to the invention are presented in the other, dependent claims.

Figure 2:
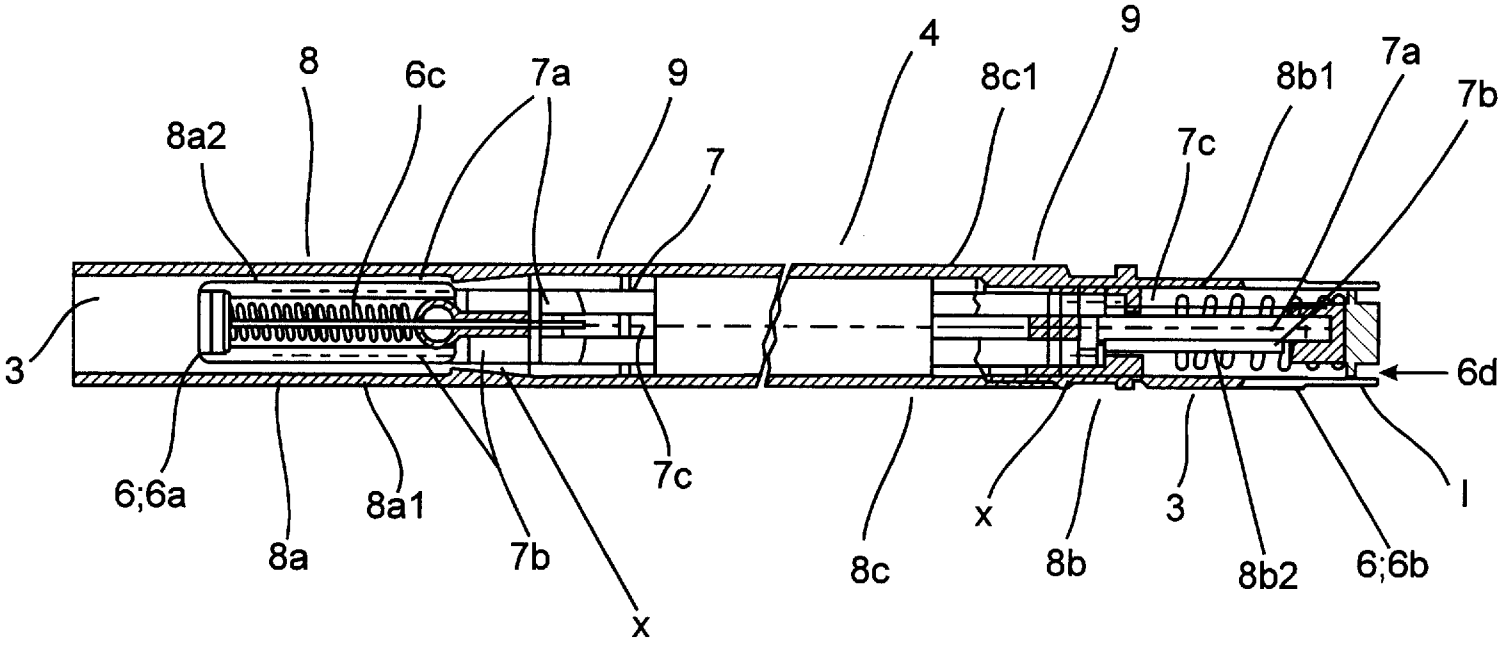
Figure 3:
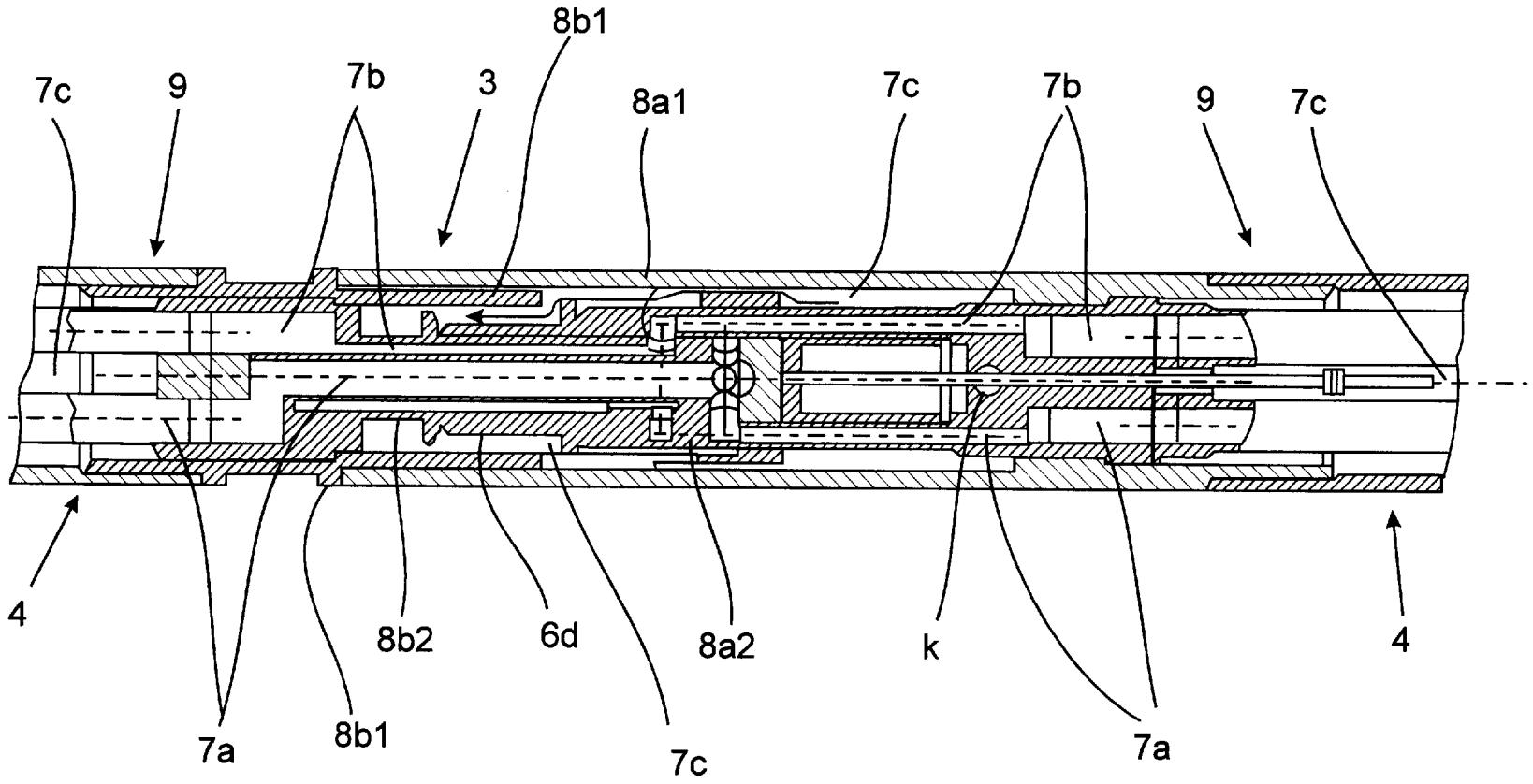
Figure 4:
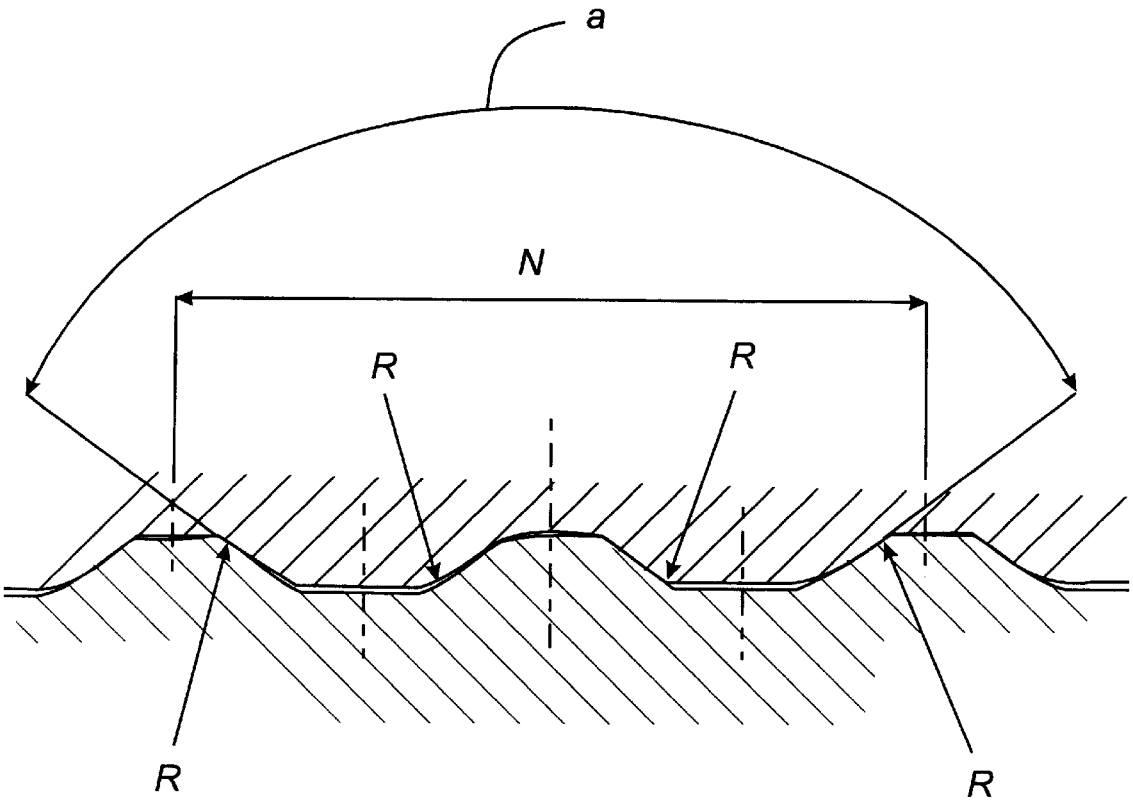

In the following description, the invention is illustrated in detail with reference to the appended drawings, in which FIG. 1 shows a typical use of the drill rod according to the invention as a side view, FIG. 2 shows an advantageous drill rod according to the invention as a longitudinal section, FIG. 3 shows a jointing point of two connected drill rods as a longitudinal section, FIG. 4 shows an advantageous thread joint arrangement existing in the drill rod.

A drill rod according to the invention is applicable for a hydraulic drilling apparatus shown for example in FIG. 1, at the drilling end I of which there is a drilling device 1, that includes at least drilling means 2 and hammering means 5 as well as preferably flushing means 10, to drill a hole by means of the drilling means 2, preferably assisted by flushing medium led to the flushing means 10 from the flushing system of the drilling apparatus and made functional by a transmission arrangement situated at the driving end II of the drilling apparatus, by a feeding motion along the longitudinal axis s of the drilling device 1 and by a rotational motion w around the longitudinal axis s as well as by a to-and-from or a like hammering motion t carried out by hydraulic fluid led to the hammering means 5 from the hydraulic system of the drilling apparatus: The drilling device 1 has jointing means 3 for fastening of a drill rod 4 preferably in a removable way to increase the drilling depth of the drilling apparatus. The drill rod 4 consists of a casing structure 8 equipped with corresponding jointing means 3 and at least partly inside of which there has been arranged a flow arrangement 7 for leading of hydraulic fluid and/or flushing medium and a coupling arrangement 6 for connecting of the flow arrangement 7 of the drill rod 4 with a corresponding flow arrangement 7 in the drilling device 1 and/or in another drill rod 4 and/or at the driving end II of the drilling apparatus. The drill rod is arranged at least partly dismountable to enable its maintenance, whereby the casing structure 8 includes an end part 8*a,* 8*b,* that is attached to a middle part 8*c* of the casing structure 8, preferably at both ends of the same by means of quick lock principle, such as by a thread joint or accordingly, in connection with which there exists at least a part of the jointing means 3, the coupling means 6 and/or the flow arrangement 7;7*a,*7*b,*7*c.*

The coupling means 6 include closing means 6*c,*6*d* arranged essentially in connection with the end part 8*a,*8*b,* which closing means, while detaching/attaching the drill rod 4, by means of auxiliary power, such as by influence of pressurized medium, spring power or like, preferably independently close/open at least the flow openings transmitting hydraulic fluid.

In the advantageous embodiments shown in FIGS. 2 and 3 in connection with each end part 8*a,*8*b* there has been arranged, preferably in a detachable way, such as by means of a thread joint or accordingly and essentially inside the end parts 8*a,*8*b,* auxiliary frame parts 8*a*2,8*b*2, that include the closing means 6*c,*6*d* and at least a part of the flow arrangement 7;7*a,*7*b,*7*c.* Accordingly each end part 8*a,* 8*b* includes a hollow cover part 8*a*1, 8*b*1, such as pipe, sleeve or the like, in which there has been arranged fastening means 9 for the middle part 8*c* and jointing means 3 at a distance apart from each other. The presented construction is especially advantageous in that way, that the male end of the coupling means 6 remains totally inside the end of the drill rod 4. In this way it is firstly possible to prevent as well as possible the breakage of the end in question and also the parts belonging to the same from moving unintentionally for example during an installation stage, whereby unintentional leakage's are prevented, also.

According to advantageous embodiment shown in FIGS. 1–3 in connection with the casing structure 8 belonging to the drill rod there has been arranged a flow arrangement 7 for leading of hydraulic fluid to the hammering means 5 through a first flow way 7*a* and for returning of the same from the hammering means 5 through a second flow way 7*b* as well as preferably for transmitting of the flushing medium between the flushing means 10 and the driving end II of the drilling apparatus through at least one third flow way 7*c.* At the first end if the drill rod 4 the has been arranged first organs 6*a* of the coupling means, such as female couplings, that are placed at least radially inside a first cover part 8*a*1 and at the second end accordingly second organs 6*b* of the coupling means, such as male couplings, that are placed correspondingly inside a second cover part 8*b*1. With reference particularly to FIG. 2 the locking unit 6*d,* such as a sleeve or a like, that is closing/opening the flow openings transmitting hydraulic fluid in the end part 8*b* of the second end of the drill rod 4, is supported in its closing position by a locking shoulder I existing at the end of the second cover part 8*b*1.

In the advantageous embodiment shown particularly in FIG. 2 the drill rod comprises a casing structure 8 as long as the drill rod 4 and the cross section of which is circular, which includes jointing means 3 that is internal and external threadings at the ends of the same. The presented embodiment has such a characteristic feature, that the casing structure 8 includes a middle L part 8*c,* at both ends of which there are corresponding end parts 8*a,*8*b* attached by fastening means 9 advantageously functioning by quick locking principle. In the presented embodiment a threading 9 has been used as the fastening means 9. In this connection it is naturally possible to take advantage of a so called bayonet joint or supply the thread joint in question additionally for example with a separate locking pin arrangement.

With reference to FIG. 2 it is possible to form the middle part 8*c* of a cover part 8*c*1 made advantageously of standard pipe, at both ends of which there has been arranged threadings 9 for the corresponding end parts 8*a*,8*b*. Particularly when keeping an eye on the middle part 8*c* it is possible in this connection to take advantage of a usual arrangement concerning the flushing medium, whereby the free space between the outside wall of the casing structure 8 and the flow ways 7*a*,7*b* for hydraulic fluid is preferably exploited as the flow way 7*c* for flushing medium. In the advantageous embodiment it is thus possible to build up the middle part 8*c* so, that inside the same there has been arranged the flow ways 7*a*,7*b* for hydraulic fluid, preferably by using standard pipe or the like. In this way it is possible to construct and prepare the middle part 8*c* as an particularly advantageous entirety, that may be changed as whole in one piece.

With reference particularly to FIG. 3 flushing medium is arranged it the first end of the drill rod 4 to be led by means of a conduit k placed in the first auxiliary frame 8*a*2 from the flow way 7*c* existing in the middle part 8*c* to a space surrounding the first auxiliary frame 8*a*2. In this case further as an advantageous embodiment the third flow way 7*c*. In the second end part 8*b* is arranged during a functional position to lead flushing medium through the second cover part 8*b*1, throughout one or several holes, grooves or the like existing therein. Further with reference to FIG. 2 at the second end of the drill rod flushing medium goes through the second cover part 8*b*1 the way described above to the space surrounding the second auxiliary frame 8*b*2, whereafter it is led to the middle part 8*b*, the space between the hydraulic pipes 7*a*,7*b* and thereafter further to the first end of the drill rod.

Significant development has been progressed in such respect also, that the coupling of the drill rods for use would be extremely efficient. In this respect research and development has ended up to the advantageous embodiment as shown in FIG. 4, wherein to enable quick fastening of the drill rod (4) the jointing means (3) are arranged by means of a two-ended, preferably rounded threading, in which the pitch N is 32.160 mm and the angle a between the sides is 110°. The advantages of the thread relative to prior art are that the coupling of separate pipes will be quick (preferably within three revolutions) and easy and that the threads will not uncouple during use. That is why the thread has two ends and also to get more contacting surface compared to a one ended thread. The double contacting surface makes sure that the threads will remain tightened during drilling.

It is obvious, that the invention is not limited to the embodiments presented or described above instead it can be modified to a great extent within the basic idea. For one thing it is thus possible to construct the drill rod so, that for example the second end of the same and the middle part are integrated, in which case the drill rod is dismountable through one of its end only. Accordingly it is possible to construct both the coupling means and the flow arrangements in most heterogeneous ways. In addition to that the joints between parts may be in certain connections formed of for example shrink or bayonet joints. Thus the presented constructions are only examples of certain advantageous embodiments, which is why the basic idea of the invention concerning gaskets and the like technical matters may be adapted in practice in most heterogeneous ways. Moreover it is possible to form the flow arrangement of the flushing means of two ducts, whereby feeding of the flushing medium takes place through the first duct and suction of the flushing medium takes place through the second duct for example through interiors of the drilling device and the drill rods.

We claim:

1. A drill rod for use with a hydraulic drilling apparatus, the hydraulic drilling apparatus including a hydraulic system, a driving end including a flushing system and a drilling end having a drilling device, the drilling device including drilling means, hammering means, and flushing means, the drilling device for drilling a hole by means of the drilling means assisted by flushing medium led to the flushing means from the flushing system of the hydraulic drilling apparatus, the drilling being performed by a feeding motion along a longitudinal axis of the hydraulic drilling apparatus, by a rotational motion around the longitudinal axis, and by a hammering motion carried out when hydraulic fluid is led to the hammering means from the hydraulic system of the hydraulic drilling apparatus, the drilling device further including jointing means for removably fastening a drill rod thereto to increase the drilling depth of the hydraulic drilling apparatus, the drill rod comprising:

a casing including casing jointing means;

a flow arrangement positioned at least partially inside the casing for leading hydraulic fluid and flushing medium through said casing; and a coupling arrangement for connecting the flow arrangement of the drill rod with a corresponding flow arrangement in the drilling device, and/or in another drill rod, and/or, or at the driving end of the hydraulic drilling apparatus, the coupling arrangement being arranged at least partly dismountable from the drilling device, the another drill rod, or the hydraulic drilling apparatus to enable maintenance of the drill rod;

whereby the casing further comprises a first end part, a second end part, and a middle part, each of the first end part and the second end part including a thread joint, the middle part including first and second ends each including a thread joint, the first and second end parts attached to the first and second ends, respectively, of the middle part by the thread joints;

the coupling arrangement further comprising closing means arranged in the first and second end parts of the casing for independently closing and opening at least the flow arrangement for transmitting hydraulic fluid to enable quick fastening of the drill rod, the casing jointing means comprising a double-start, rounded thread for releasably locking the casing to the drilling device.

2. A drill rod according to claim 1, wherein the flow arrangement includes a plurality of non-concentric flow pipes radially separated so as to avoid heat transfer therebetween.

3. A drill rod according to claim 1, wherein said coupling arrangement further comprises an auxiliary frame which includes the closing means, the auxiliary frame including a thread joint for detachably connecting to the first end part and the second end part, portions of the auxiliary frame positioned inside the first end part and the second end part.

4. A drill rod according to claim 1, wherein the flow arrangement further comprises a first flow path for leading hydraulic fluid to the hammering means and a second flow path for returning hydraulic fluid from the hammering means, and a third flow path for transmitting flushing medium between the flushing means and the driving end of the drilling apparatus, the casing further comprising a first cover part and a second cover part, wherein the coupling arrangement further comprises first female coupling portions arranged at the first end of the casing at least radially inside the first cover part, wherein the coupling arrangement further comprises second male coupling portions arranged at the second end of the casing at least radially inside the second cover part, said first female coupling portion further comprising a locking unit including a sleeve which selectively opens and closes the first flow path, the second cover part including a locking shoulder which supports the locking unit.

5. A drill rod according to claim 1, wherein the middle part of the casing includes at least one first flow path and at least one second flow path for hydraulic fluid, the at least one first flow path, the at least one second flow path, and the casing having free space therebetween, whereby the free space comprises a flow path for flushing medium, and wherein the coupling arrangement further comprises a conduit fluidly communicating the flushing medium flow path to the free space.

6. A drill rod according to claim 5, wherein the coupling arrangement further comprises at least one hole therethrough, and the flushing medium flow path is arranged to lead flushing medium at least partly through the at least one hole.

7. A drill rod according to claim 1, wherein the double-start, rounded thread has a pitch of about 32.160 mm and an angle between its sides of about 110°.

* * * * *